United States Patent [19]

Hodulik

[11] 4,268,545

[45] May 19, 1981

[54] METHOD OF AND APPARATUS FOR PRINTING A PATTERN ON A SUBSTRATE

[75] Inventor: Joseph W. Hodulik, Genoa, Ohio

[73] Assignee: Libbey-Owens-Ford Company, Toledo, Ohio

[21] Appl. No.: 61,616

[22] Filed: Jul. 30, 1979

[51] Int. Cl.[3] ..... B05D 1/32

[52] U.S. Cl. ..... 427/282; 101/127; 101/129; 118/213; 118/504; 118/505

[58] Field of Search ..... 427/282; 101/127, 129; 118/300, 213, 504, 505

[56] References Cited

U.S. PATENT DOCUMENTS 3,419,413 12/1968 Euforbia ..... 427/282

3,667,990 6/1972 Rogers ..... 427/282

3,927,943 12/1975 Pohl et al. ..... 101/128.1

*Primary Examiner*—Ronald H. Smith

*Assistant Examiner*—Janyce A. Bell

*Attorney, Agent, or Firm*—Collins, Oberlin & Darr

[57] ABSTRACT

A screen support in the form of a segmental collar for use in a screen stenciling operation. The collar segments are movable into engagement with at least the transverse marginal edges of a glass substrate for accurately locating the same relative to an overlying screen and for providing support for the screen, and especially the perforated pattern formed therein, to maintain the same in a flat, horizontal plane during the stenciling operation.

10 Claims, 5 Drawing Figures

METHOD OF AND APPARATUS FOR PRINTING A PATTERN ON A SUBSTRATE

BACKGROUND OF THE INVENTION

The present invention relates generally to the screen stenciling of a pattern on an underlying substrate, such as a glass sheet for example, and, more particularly, to a support for the screen employed in such a stenciling operation.

One of the most common expedients for applying patterns or designs on glass sheets for use in specific applications, such as for glazing closures in automobiles and the like, is the well-known "silk screen" stenciling or printing technique. Generally, the glass sheets are individually positioned beneath an elevated screen assembly which is then lowered onto the glass sheet. The printing material is then forced, as by a squeegee for example, through the perforated area constituting the pattern in the screen onto the glass sheet to form the desired pattern thereon. The screen is then lifted off the glass sheet to allow replacement of the printed sheet with a fresh sheet.

Usually, the printed design, which may be in the form of indicia, bands, stripes or the like, is applied interiorly of the marginal edges of the glass sheets and conventional coating or silk screen printing machines have satisfactorily performed this function. However, recent automotive styling features require the application of a band of coating material of predetermined width along the entire marginal edge of such sheets, the outer peripheral edge of the band extending right up to the marginal edge of the sheet. This has posed problems in conventional screen stenciling apparatus because the perforated pattern of the screen must extend slightly past the marginal edge of the sheet in order to ensure the application of coating material right up to such edge. As a result, the squeegee force, during its traverse across the pattern at such edge, stretches and/or bends the pattern portion thereover. This repeated action prematurely weakens and often tears the pattern portion of the screen, requiring frequent, costly screen replacement and consequent loss of production to effect such replacement.

SUMMARY OF THE INVENTION

Accordingly, it is an object of the present invention to provide an improved method of and apparatus for applying coating or printing material to substrates and which embodies novel features to extend the useful life of the stencil screen employed in such apparatus.

It is another object of this invention to provide in the foregoing apparatus a new and useful support for the screen when disposed in its operative, substrate engaging position.

It is still another object of this invention to form the foregoing support in segments movable into positions at least partially enclosing the substrate to assist in aligning the same as well as offering support for the screen.

It is a further object of the present invention to provide an improved stenciling method of applying coating material to the very edge of a substrate while offering support for the pattern portion of the stencil screen employed in such a process.

The foregoing and other objects, advantages, and characterizing features of the present invention will become clearly apparent from the ensuing detailed description thereof, considered in conjunction with the accompanying drawings, wherein like reference numerals denote like parts throughout the various views.

DESCRIPTION OF THE PREFERRED EMBODIMENT

Figure 1:
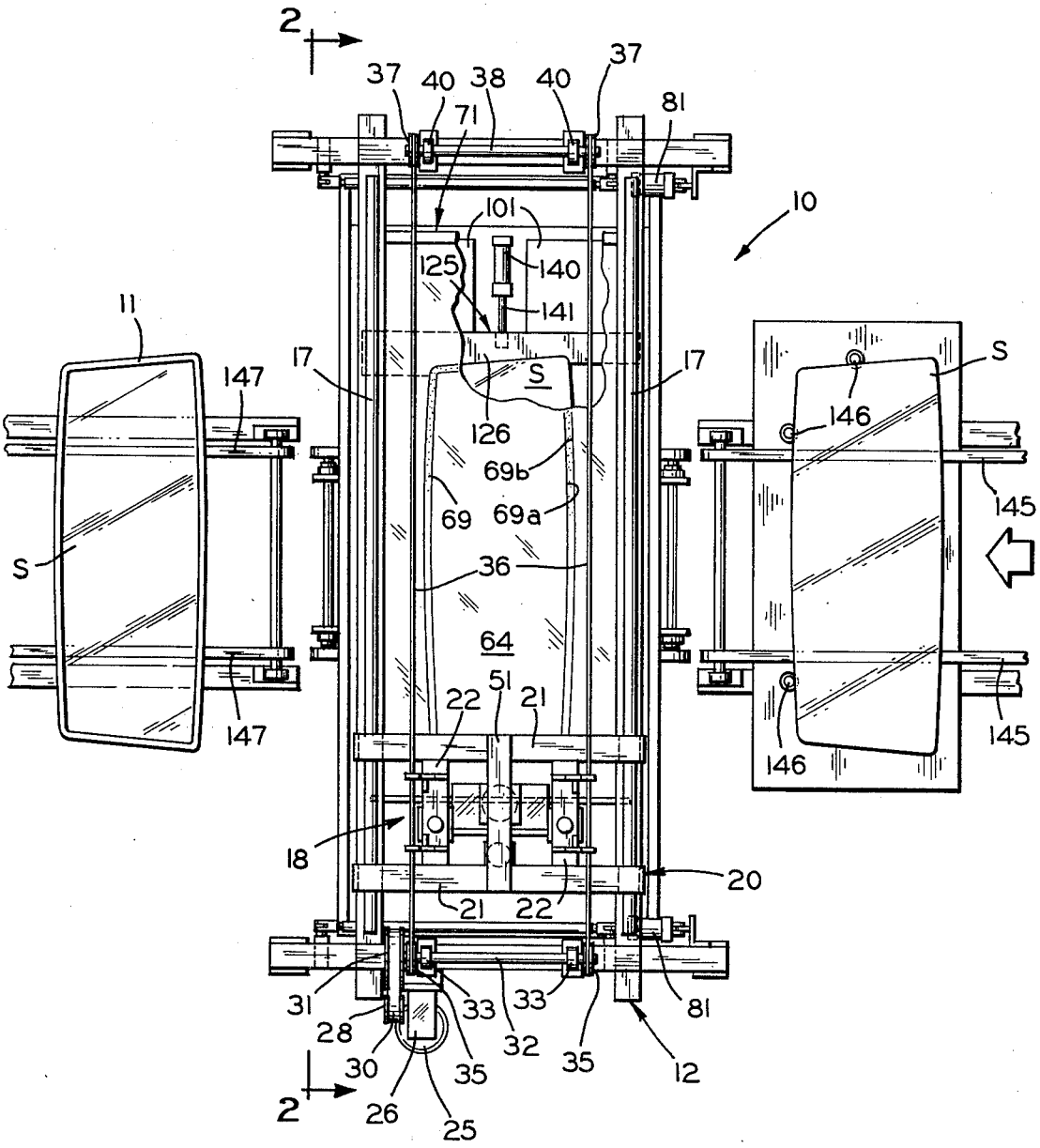
FIG. 1 is a top plan view of a screen stenciling apparatus, partly broken away for clarity, and embodying certain novel features of the present invention.

Referring now in detail to the illustrated embodiment depicted in the accompanying drawings, there is shown in FIG. 1 a coating apparatus of the "silk screen" stenciling type, comprehensively designated 10, embodying the novel features of this invention for applying a pattern on the upper surface of a substrate, specifically a glass sheet S. In the illustrative embodiment depicted, the pattern is in the form of a band 11 of predetermined width extending along the entire marginal edge portion of the glass sheet S and having an outer peripheral edge coincident with the marginal edge of the sheet, i.e. the band 11 extends to the very edge of the sheet S.

The apparatus 10 comprises a frame 12 including a plurality of columns 13 connected at their upper ends by transversely extending, horizontal structural members 15. These members 15 in turn, support spaced, longitudinally extending, horizontal structural members 16 to provide a rigid, box-like structure. Suitable cross or tie members (not shown) are welded or otherwise fixedly secured at their respective opposite ends to the members 15 and 16 to provide the requisite stability and rigidity.

A pair of laterally spaced, elongated rod-like track or rail elements 17 are suitably secured to the upper ends of structural members 16 for supporting a carriage, generally designated 18, mounted for reciprocal movement therealong. The carriage 18 comprises a frame 20 made up of a pair of laterally spaced, longitudinal beam members 21 and a pair of hollow cross members 22 suitably connected at their respective opposite ends to the beams 21. A pair of laterally spaced guide elements 23 are affixed to each beam member 21 and project downwardly therefrom with the pair of guide elements 23 of one beam member 21 being coaxially aligned with the pair of guide elements 23 of the other member 21 to embrace the rail elements 17 for reciprocal sliding movement therealong.

The means for reciprocating carriage 18 includes an electric motor 25 connected to a suitable source of electrical power (not shown) and, via a gear reduction box 26, to a drive shaft 27 provided with a pulley 28. A timing belt 30 is entrained about pulley 28 and a pulley 31 rigidly secured on the end of a shaft 32 mounted on one end of the frame superstructure and suitably journalled in spaced bearings 33 (FIG. 1). Also rigidly secured on shaft 32 adjacent the opposite ends thereof are a pair of drive pulleys 35 having cables 36 entrained thereabout and about guide pulleys 37 mounted on a shaft 38 at the other end of the frame superstructure and suitably journalled for rotation in spaced bearings 40. The ends of each cable 36 are provided with connectors 41 coupled to eye-bolts 42 suitably anchored in support brackets 43 mounted on the cross members 22. Suitable apertures 45 are formed in the brackets 43 for further guiding the upper runs of cables 36. Thus, the carriage 18 is mounted for reciprocal movement longitudinally of the frame 12 above a substrate supporting table, hereinafter described.

The carriage 18 includes means for supporting the squeegee and flood bar assembly, generally designated 46, hereinafter more fully described. Such supporting means includes a fluid cylinder 47 pivotally mounted, as at 48 in FIG. 3, to a lug 50 depending downwardly from the central portion of a hollow beam member 51 rigidly secured adjacent its opposite ends to the carriage frame beam members 21. The cylinder 47 is provided with the usual reciprocating piston (not shown) having a piston rod 52 attached at its outer end to a yoke 53 pivotally connected to an upstanding lug 55 mounted on an elongated platen 56. The platen 56 is provided with a pair of downwardly extending flanges 57 which are suitably apertured to receive pivot pins 58 projecting laterally outwardly from the base member 60 of the squeegee and flood bar assembly 46. Thus, the cylinder 47 supports the squeegee and flood bar assembly 46 on carriage 18 and serves to raise and lower the assembly 46, as desired.

A pair of guide posts 61 are mounted at their upper ends to cross members 22 and extend downwardly through vertically spaced bushings 62 affixed to upright plates 63 welded or otherwise fixedly secured to platen 56. The bushings 62 move vertically along with platen 56 for sliding movement along the posts 61 to guide the platen 56 during its vertical reciprocal movement.

The squeegee and flood bar assembly 46 is suspended from carriage 18 to move longitudinally therewith relative to a stencil screen 64 disposed therebeneath as will hereinafter be described. The assembly 46 includes an elongated squeegee bar 65 and an elongated flood bar 66 mounted in angular relation with each other on the base member 60. The squeegee bar 65 is adapted to engage the underlying screen 64 for forcing the coating or printing material therethrough into a desired pattern on the underlying substrate, i.e. glass sheet S, as the bar 65 moves longitudinally by the carriage 18 across the screen 64. The flood bar 66, when in its operative, proximate position adjacent the screen 64, functions to distribute or disperse the coating material uniformly over the underlying screen 64 during the return stroke of the carriage 18 in readiness for the next printing operation. Accordingly, the squeegee bar 65 and flood bar 66 are alternately moved into their operative positions during reciprocal movement of the carriage 18.

The means for shifting either the squeegee bar 65 or flood bar 66 into their respective operative positions includes a fluid cylinder 67 suitably pivotally mounted on frame 12 and having a piston rod 68 pivotally connected at its lower end to a bracket 70 rigidly secured to the base member 60 of squeegee and flood bar assembly 46. During movement of the carriage 18 in one direction, such as to the left as viewed in FIG. 2, the cylinder 67 is operative to bring squeegee bar 65 into contact with the screen 64 to effect stenciling or printing. At the end of the stroke, the cylinder 67 is operative to pivot base member 60 for pivoting squeegee bar 65 upwardly into an out-of-the-way position while swinging the flood bar 66 into its operative position wherein the lower edge of the bar 66 is in close proximity to the screen 64. Thus, upon carriage return, the flood bar 66 will spread or distribute the printing material evenly across the underlying screen 64.

The stencil screen 64, hereinafter sometimes referred to as a "silk screen," is of conventional construction and, in the illustrated embodiment depicted in FIG. 1, is formed with a generally rectangularly shaped design or pattern 69 of uniform width defined by an inner edge **69*a* and an outer edge 69*b*. While the major body portion of screen 64 is coated or otherwise formed to be impervious against the flow of the printing material therethrough, the pattern 19 is permeable and constitutes a perforated area which permits the passage of the printing material therethrough. The screen 64 contacts the glass in a manner positioning the pattern 69 along the marginal edge portion of the glass sheet with the outer peripheral edge 69*b* thereof projecting just slightly past the glass marginal edge. This minimal overlap of the pattern 19** relative to the edge of the glass assures printing of the material onto the latter right up to the very edge thereof.

Figure 2:
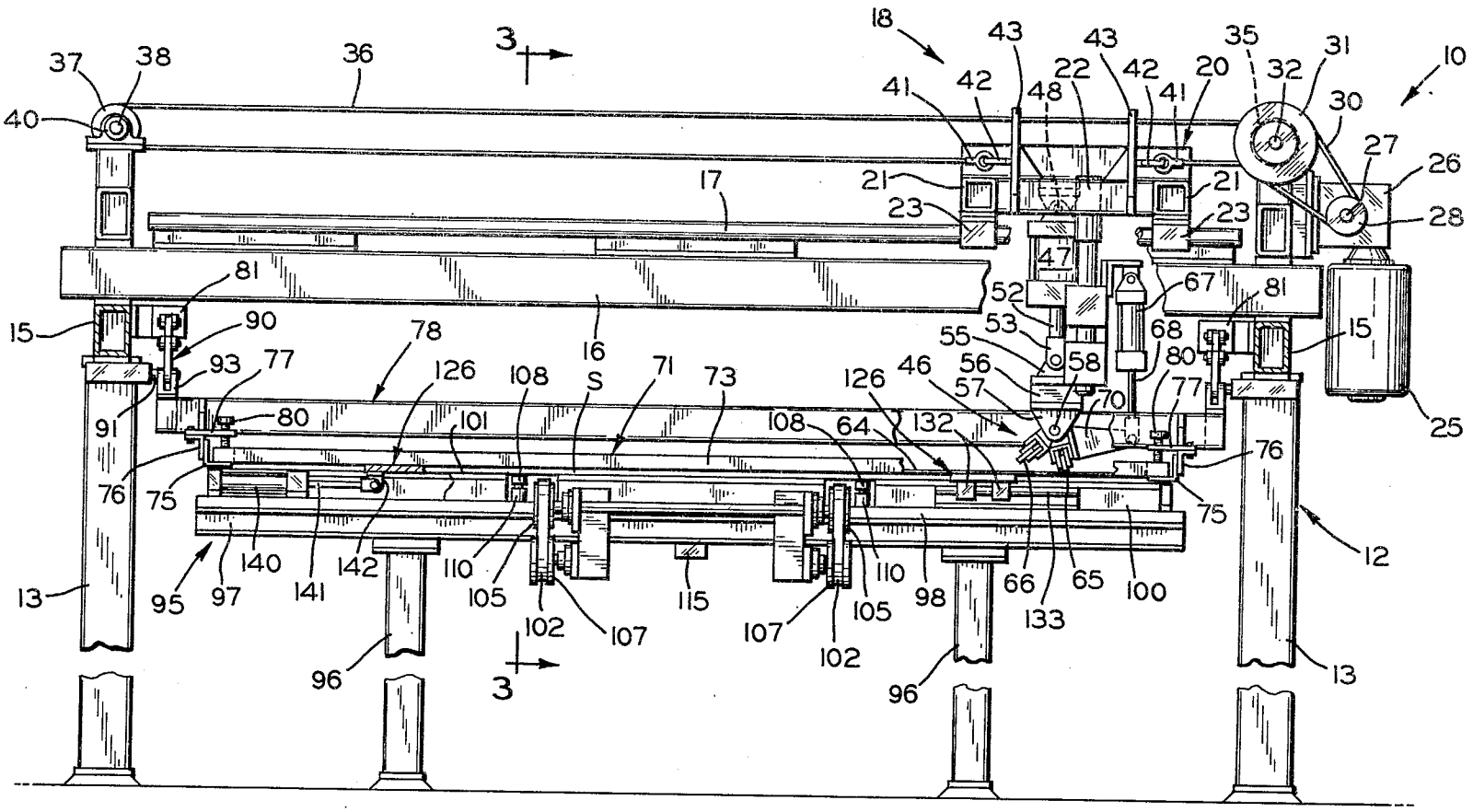
FIG. 2 is a rear elevational view, partly in section, of the apparatus of FIG. 1 and looking in the direction of arrows 2—2 of FIG. 1.

The screen 64 is mounted for vertical reciprocal movement between the squeegee and flood bar assembly 46 and the upper surface of the table top, hereinafter described. The silk screen 64 is supported on a frame member, generally designated 71, comprised of longitudinal side members 72 and transverse side members 73. As shown in FIG. 2, the frame member 71 is supported on angle irons 75 rigidly secured to angle members 76 attached to the underside of horizontal brackets 77, in turn affixed to a movable support 78. Each bracket 77 is provided with a screw 80 projecting therethrough for engagement against the upper surface of the screen frame member 71 to clamp the same in place. While the stencil screen 64 is commonly referred to as a "silk screen" in the art and also in this description, it should be appreciated that the screen is not necessarily made of silk but can be formed of any suitable material having the necessary resistance to chemical and mechanical deterioration, such as stainless steel, nylon and/or other synthetic materials for example.

Figure 3:
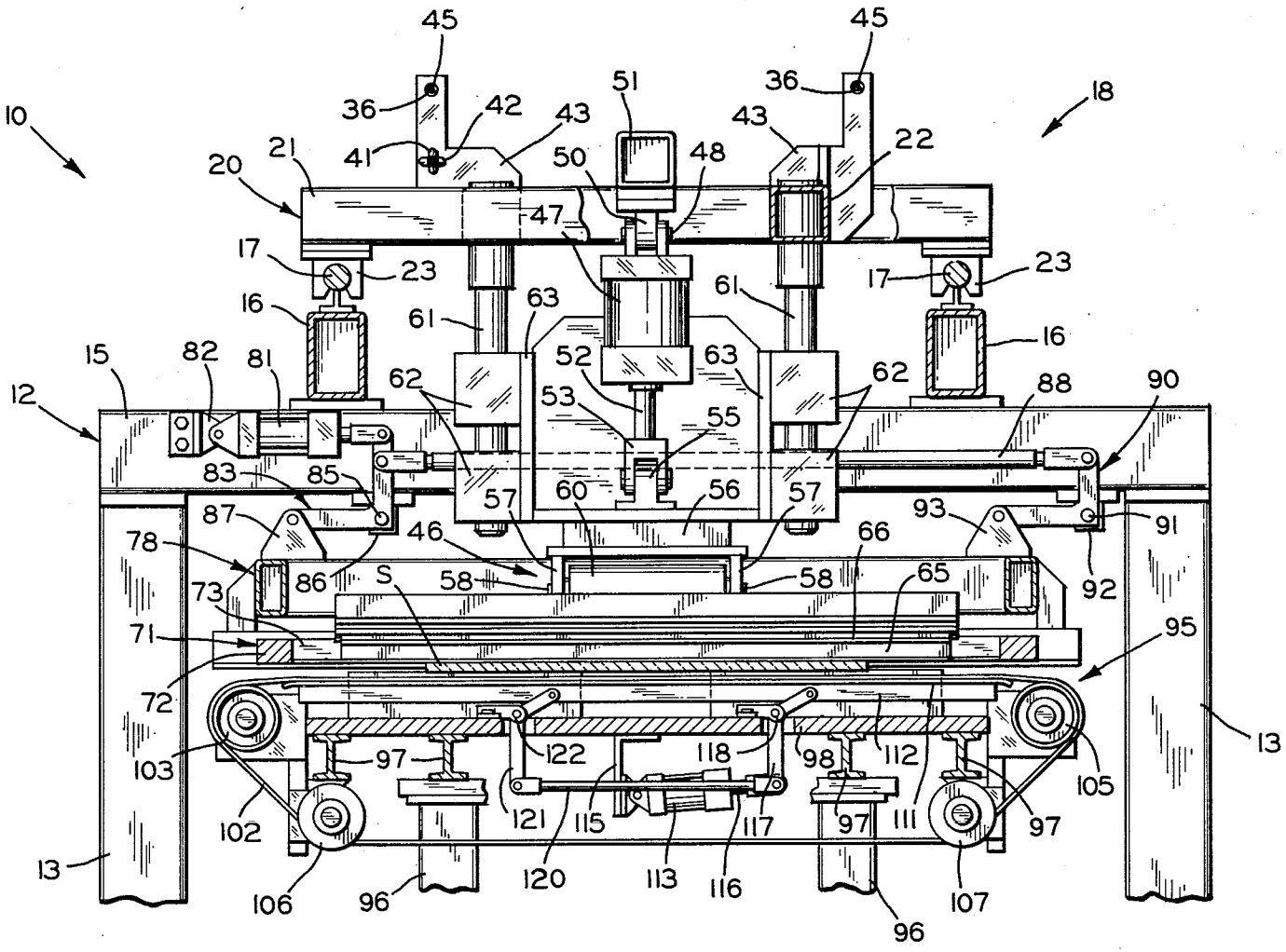
FIG. 3 is a vertical cross sectional view, on an enlarged scale, taken along the line 3—3 of FIG. 2.

As best shown in FIG. 3, the means for raising and lowering the screen 64 relative to the glass sheet S disposed on the table top includes a fluid cylinder 81 pivotally mounted at its head end on a mounting bracket 82 secured to structural member 15. Cylinder 81 is provided with a piston rod pivotally connected at its outer end to a bell crank 83 pivotally mounted, as at 85 in FIG. 3, on a lug 86 affixed to the underside of structural member 15. The other end of bell crank 83 is pivotally attached on an upstanding lug 87 rigidly secured on the movable support 78 adjacent one end thereof.

The bell crank 83 is operatively connected by means of a connecting rod 88 to another bell crank 90 pivotally mounted, as at 91 in FIG. 3, on a lug 92 rigidly secured to the underside of structural member 15. The distal end of bell crank 90 is pivotally connected to an upstanding lug 93 mounted on the movable support 78 adjacent the other end thereof. Thus, actuation of cylinder 81 pivots both bell cranks 83 and 90 in unison to effect raising and lowering of the support 78 and thereby the screen 64.

The means for individually supporting the glass sheets to be printed include a table, generally designated 95, located beneath the suspended screen 64 and suitably supported on a plurality of legs 96. The upper ends of the legs 96 are connected by laterally spaced, longitudinally extending, horizontal structural members 97, which in turn support the base 98 of table 95. A plurality of spaced, generally rectangularly shaped segments 100 (FIG. 4) constitute the table top and are provided with upper surfaces, collectively identified by numeral 101, for supporting the glass sheet to be printed. The spaces between segments 100 provide clearance or passageways for the glass aligning devices and conveyor belts, hereinafter identified and described, and which are raised above the supporting surface 101 during operation of the apparatus.

A pair of laterally spaced, endless conveyor belts 102 are mounted on the table 95 for orbital movement thereabout to receive the glass sheet from an incoming conveyor and advance the sheet into the desired position above the table top surface 101. As best shown in FIG. 3, each conveyor belt 102 is entrained and driven about a pair of spaced pulleys 103 and 105 and a pair of spaced tension pulleys 106 and 107, all suitably journalled for rotation on the table frame structure. Suitable means are provided for driving one or the other of pulleys 103 and 105 to move the conveyor belts 102 in unison in their orbital paths. The tension pulleys 106 and 107 are operative to impart the necessary slack and tension, as required, to the conveyor belts 102 upon vertical movement of the active runs thereof, as will hereinafter be more fully explained.

A pair of laterally spaced aligning devices in the form of retractable stop members 108 are positioned in the path of movement of an advancing glass sheet S to interrupt movement thereof and accurately position the leading edge thereof relative to screen 64. Each stop 108 is connected to the piston rod of a fluid cylinder 110 mounted on the table base member 98. The cylinders 110 are operative to raise and lower stop members 108 between an upper position above table top surface 101 in the path of movement of the glass sheet S and a lower position therebeneath.

The active runs of conveyor belts 102 are adapted to be raised and lowered to advance the sheet S above table top surface 101 and then deposit such sheet thereon. To this end, the active run of each belt 102 is entrained over a guide plate 111 supported on a vertically movable base plate 112. The means for vertically moving each base plate 112 includes a fluid cylinder 113 pivotally mounted at its head end on a support 115 attached to the underside of base member 98. The distal end of the cylinder piston rod 116 is pivotally connected to one end of a bell crank 117 pivotally mounted on a lug 118 affixed to base member 98. The other end of bell crank 117 is suitably connected to the base plate 112. Bell crank 117 is connected by means of a connecting rod 120 to one end of a second bell crank 121 pivotally mounted on a lug 122 affixed to base member 98 and connected at its other end to the support plate 112. Thus, simultaneous actuation of the cylinders 113 effects pivotal movement of the two pairs of bell cranks 117 and 121 to raise and lower base plate 112 and thereby the associated belts 102 above and below the table top surface 101. The tension pulleys 106 and 107 are operative to relax and tighten the belts 102 as required to accommodate such conveyor belt movement. The glass sheet S is advanced on belts 102 when in their raised position until the sheet engages stops 108. The belts 102 are then lowered to deposit the sheet on table top surface 101 in the desired position relative to the overlying screen 64. In operation, the screen 64, initially in an upper position to permit conveyance of a glass sheet into position for deposit on table top surface 101, is lowered by means of the bell crank arrangement 83, 88, and 90 onto the glass sheet. The squeegee 64 is then lowered by cylinder 47 and brought into contact with the screen 64. The carriage 18 is actuated to move the squeegee bar 65 longitudinally along the silk screen 64 to force the coating or printing material, previously flooded or dispersed on the silk screen, through the pattern 69 in the screen 64 for applying such material onto the upper surface of the glass sheet S.

It has been found that when applying the printing material to the very edge of the glass sheet, as when applying a peripheral band on the upper surface thereof as identified by numeral 11 in FIG. 1, the squeegee force acting on the perforated pattern 69 of the screen, which pattern 69 extends slightly past the marginal edge of the sheet, tends to bend or stretch the pattern 69 over such edge, causing the screen to wear prematurely and requiring frequent replacement. Such frequent replacement of an expensive silk screen, as well as the apparatus "downtime" to effect such replacement, materially increases production costs.

Figure 4:
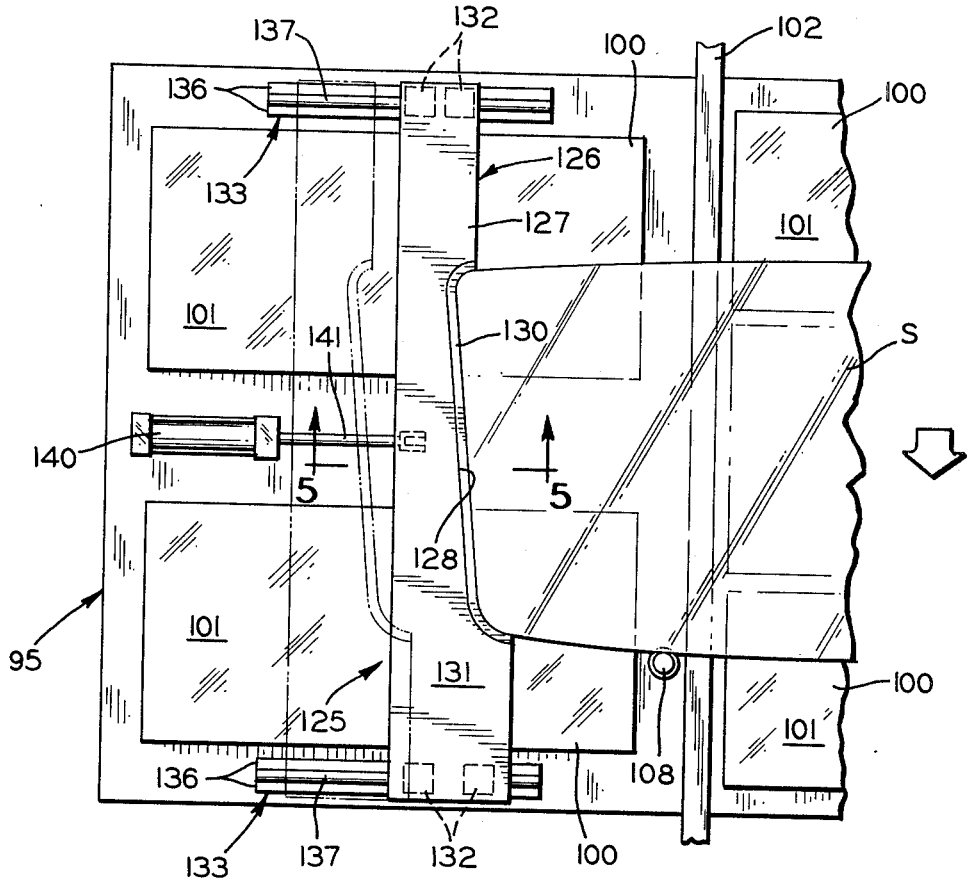
FIG. 4 is a fragmentary, top plan view of the apparatus of FIG. 1, showing one segment of a stencil screen support constructed in accordance with this invention.

The present invention addresses this problem by providing a support in the form of a segmental collar, generally designated 125, adapted to at least surround the transverse marginal edges of the glass sheet to be printed and offers support for the screen 64, and especially pattern 69, to maintain the same in a horizontal plane or a flat condition throughout the entire printing operation. The collar 125 is comprised of opposed segments 126 (only one of which is shown in FIG. 4) movable toward and away from each other, as will presently appear. Each segment 126 comprises an elongated flat plate 127 extending crosswise of table 95 and mounted for reciprocal movement longitudinally thereof. The inner edge of each plate 127 is provided with a cut-away section defined by an indented edge surface 128 complementary to the shape of the marginal transverse edge of the sheet. This indented edge surface 128 is lined with a strip 130 of suitable elastomeric material, preferably polyurethane for example, to provide a resiliently yieldable abutment surface engageable with the marginal transverse edge portion of the sheet to avoid damage thereto. Each plate 127 is provided with an upper planar surface 131 disposed in the same horizontal plane as the sheet to be printed.

Means are provided for guiding the collar segments 126 in a straight horizontal path toward and away from each other and includes a pair of coaxially aligned slides 132 rigidly secured to the underside of each collar plate 127 adjacent each opposite end thereof. These slides 132 ride on longitudinally extending rails 133 suitably secured to the table base member 98. Each of the rails 133 comprises a vertical web 135 upstanding from laterally projecting flanges 136 on opposite sides thereof and surmounted by a generally bulbous shaped, longitudinally extending rod 137 adapted to be embraced by the associated slides 132.

Figure 5:
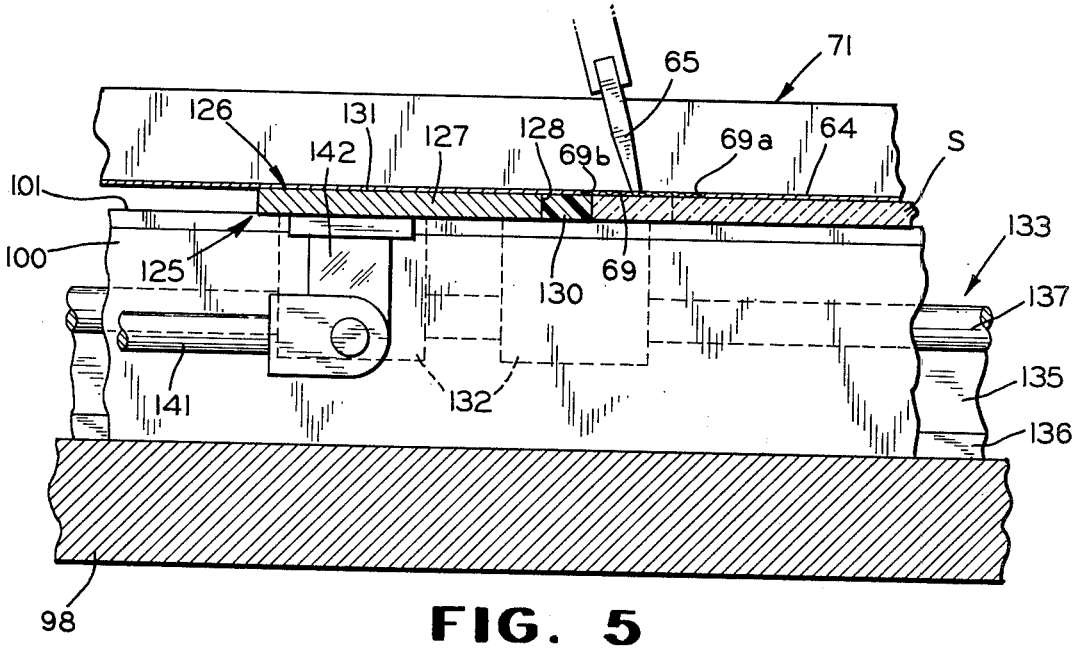
FIG. 5 is a fragmentary, vertical sectional view, on an enlarged scale, taken along the line 5—5 of FIG. 4, and further showing a squeegee bar and stencil screen in their respective operative positions.

The means for reciprocating each collar 126 along table 95 includes a fluid cylinder 140 suitably secured at its head end on the table base 98 and having the usual reciprocal piston (not shown) provided with a piston rod 141 connected at its distal end to a lug 142 extending downwardly from and fixedly secured to the underside of segment 126. When the sheet S is properly deposited on table supporting surface 101, the cylinders 140 are actuated to extend their associated piston rods 141 and shift the opposed collar segments 126 toward the sheet S into nested engagement with the opposite transverse edges thereof. As the segments 126 engage the sheet, they precisely locate the same in the desired vertical alignment with the overlying silk screen 64. As best shown in FIG. 5, the upper planar surface 131 of each segment 126 resides in the same horizontal plane as the upper surface of the sheet S. Thus, the segments 126 support and maintain the screen 64, particularly the pattern portion 69 thereof, in a horizontal plane throughout as the squeegee 65 passes thereover to avoid stretching and bending of such pattern 69 over the glass sheet edge as would otherwise occur in the absence of such collar segments.

While the segments 126 illustrated are provided with cut-outs to form indented edge surfaces 128 complementary to and engageable with the entire opposite transverse edge portions of the sheet and only a small portion of the longitudinal edges thereof, it should be appreciated that the collar segments 126 can be materially widened and the surfaces 128 extended and shaped in a longitudinal direction to embrace the entire sheet S when moved into their inner, nested positions in abutting engagement therewith.

The mode of operation of the above-described apparatus embodying the novel collar arrangement of this invention in applying a peripheral band 11 on a glass substrate is as follows:

With the squeegee and flood bar assembly 46 and screen 64 in an elevated position and conveyor belts 102 raised above the table top, an incoming glass sheet S, initially located on conveyor belts 145 in the desired orientation as by stops 146, is released and advanced on such belts 145 to the coating or printing station. The sheet is transferred from the conveyor belts 145 onto the conveyor belts 102 and advanced over the table 95 against the stops 108 to generally align the leading edge of the sheet with the overlying screen 64. When the leading edge of the glass sheet S engages the stops 180, cylinder 113 is actuated to lower the base plate 112 and thereby the conveyor belts 102 from their elevated positions as shown in FIG. 3 above the table top surface 101 to their lower positions therebeneath, depositing the sheet thereon. With the sheet placed on surface 101, cylinders 140 are actuated to move the opposed collar segments 126 inwardly into engagement with the transverse marginal edges of the sheet. The segments 126 serve to accurately align the sheet below the screen 64 for precise vertical registration therewith. As the segments move into embracing relation with the sheet, cylinders 110 are actuated to retract locator stops 108 below the table top supporting surface 101.

When the sheet properly located on the table top supporting surface 101, cylinders 81 are actuated to lower the screen 64 onto the glass sheet, positioning the pattern 19 along the marginal edge portion of the sheet. As shown in FIG. 5, the pattern 69 projects slightly past (69*b*) the marginal edge of the sheet to ensure subsequent printing right up to the very edge of the sheet. Cylinder 47 then becomes operative to lower the squeegee bar 65 onto screen 64. With the screen 64 having been previously flooded with printing material, the squeegee bar 65 is then moved longitudinally, as by movement of the carriage 18, along the screen 64 to force the printing material through the pattern 69 formed in the screen and thereby apply the desired band 11 onto the upper surface of the sheet S. The collar segments 126 support that portion of the pattern 19 extending slightly past the marginal edge of the glass sheet (FIG. 5) as the squeegee bar 30 sweeps thereover to maintain it in a horizontal plane flush with the glass surface and thereby avoid any bending and/or stretching of such pattern 19 as would otherwise occur in the absence of segments 126.

At the completion of the printing stroke, cylinders 47 and 81 are sequentially actuated to raise the squeegee and flood bar assembly 46 and silk screen 64, respectively, leaving the desired printed band 11 on sheet S. Cylinder 67 is then actuated to pivot bracket 70 for moving the squeegee bar 65 out of the way and the flood bar 66 into its operative position. The flood bar 66 is then lowered, as by cylinder 47, into close proximity to the screen 64 and moved longitudinally by carriage 18 in a reverse direction to redistribute the printing material evenly on the upper surface of the screen 64.

Once the screen 64 is lifted off the glass sheet S, the collar segments 126 can be retracted and conveyor belts 102 raised to lift the sheet off the table top surface 101 and advance the same out of the printing station and transfer the printed sheet onto another pair of conveyor belts 147 for advancement to a further processing station. When a sheet clears the printing station, the stops 108 can be extended in readiness for the next succeeding sheet to be printed and the above-described cycle is repeated.

Actuation of the various cylinders and conveyor belt drives is effected by conventional fluid control valves and motors (not shown) sequenced for operation by conventional limit switches and/or timers (also not shown) incorporated in the control system. Each of the switches and/or timers triggers successive stages of operation of the various actuators and conveyor drives in a timed, cyclic relation to effect an automated operation and, since such arrangements are known and, per se, form no part of the present invention, no detailed description or further amplification thereof is believed necessary.

From the foregoing, it is apparent that the objects of this invention have been fully accomplished. As a result of this invention and by the provision of a collar arrangement adapted to embrace at least portions of the marginal edges of a glass substrate, support is offered for the screen to maintain the same, and especially the pattern formed therein, in a horizontal plane or flat condition throughout during the stenciling or printing operation to extend the useful life thereof. The collar segments not only materially prolong the useful life of the screen, but also assist in precisely locating the sheet relative to the screen.

It is to be understood that the form of the invention herein shown and described is to be taken as an illustrative embodiment only of the same, and that various changes in the shape, size and arrangement of parts, as well as various procedural changes, may be resorted to without departing from the spirit of the invention.

I claim:

1. A method of applying a peripheral band onto a flat substrate comprising: positioning a substrate on a supporting surface, engaging at least the opposite edge portions of said substrate with segments having edges complementary to and engageable with the entirety of said substrate opposite edge portions, placing a stencil screen having a pattern formed therein on said substrate, positioning said pattern to orient a portion thereof projecting slightly outwardly past the marginal edge of said substrate, supporting said projecting portion of said pattern on said segments to maintain said pattern and screen in a horizontal plane while applying coating material through said pattern onto the upper surface of said substrate to form a peripheral band thereon.

2. A method according to claim 1, including aligning said substrate in proper registry with said screen by moving said segments on said supporting surface inwardly into engagement with said substrate edge portions.

3. A method according to claim 1, wherein said coating material is forced through said pattern by moving a squeegee bar thereacross to apply said coating material on said substrate upper surface to said marginal edge thereof.

4. In apparatus for applying coating material in a desired configuration onto a flat substrate positioned on a supporting surface and including a stencil screen having a pattern formed therein disposed above said supporting surface and adapted to engage said substrate, and means for forcing coating material through said pattern of said screen in a desired configuration onto the upper surface of said substrate, the improvement comprising means on said supporting surface movable into engagement with at least the opposite edge portions of said substrate for encircling said opposite edge portions, said substrate engaging means including means for supporting at least a portion of said pattern during the coating operation.

5. Apparatus according to claim 4, wherein said substrate engaging means comprises at least a pair of segments having opposed edges complementary to said opposite edge portions of said substrate.

6. Apparatus according to claim 5, including means for reciprocating said opposed segments toward and away from said substrate.

7. Apparatus according to claim 5, wherein said segments are formed of metal and said opposed edges are lined with an elastomeric material.

8. Apparatus according to claim 7, wherein said elastomeric material is polyurethane.

9. Apparatus according to claim 6, including means for guiding said segments for reciprocal sliding movement in a horizontal path.

10. Apparatus according to claim 5, wherein said supporting means constitutes planar horizontal surfaces formed on said segments, said horizontal surfaces lying in a common horizontal plane with the upper surface of said substrate.

* * * * *

UNITED STATES PATENT AND TRADEMARK OFFICE

CERTIFICATE OF CORRECTION

PATENT NO. : 4,268,545

DATED : May 19, 1981

INVENTOR(S) : Joseph W. Hodulik

It is certified that error appears in the above-identified patent and that said Letters Patent are hereby corrected as shown below:

Col. 6, line 8, "64" should be --65--
Col. 7, line 43, "180" should be --108--
line 57, "When" should be --With--

Signed and Sealed this

*Fifteenth* Day of *September 1981*

[SEAL]

*Attest:*

GERALD J. MOSSINGHOFF

*Attesting Officer*

*Commissioner of Patents and Trademarks*